United States Patent [19]

Bechtel

[11] 4,097,045

[45] Jun. 27, 1978

[54] BOWLING RAMP

[75] Inventor: Russell D. Bechtel, Pensacola, Fla.

[73] Assignee: The Raymond Lee Organization, Inc., New York, N.Y. ; a part interest

[21] Appl. No.: 792,008

[22] Filed: Apr. 28, 1977

[51] Int. Cl.[2] ..... A63D 5/00

[52] U.S. Cl. ..... 273/54 R; 273/129 E

[58] Field of Search ..... 273/54 R, 129 E; 108/156

[56] References Cited

U.S. PATENT DOCUMENTS

| | | | |
|---|---|---|---|
| 147,969 | 2/1874 | Peabody | 108/156 X |
| 1,762,776 | 6/1930 | Gardner | 108/156 X |
| 3,159,401 | 12/1964 | Ikenberry | 273/54 R |
| 3,539,183 | 11/1970 | Lieb | 273/54 R |

*Primary Examiner*—Anton O. Oechsle

*Attorney, Agent, or Firm*—Daniel Jay Tick

[57] ABSTRACT

A portable ramp for a bowling ball is bent at approximately 135° to form a first linear section of predetermined length and a second linear section having a length approximately three times the predetermined length. The second section extends angularly from the first section and curves slightly at its end farthest from the first section. The ramp has a top with a central channel extending along its length for directing a bowling ball. A pair of legs are removably accommodated in a pair of spaced socket members at the bottom of the first section of the ramp intermediate its end joining the second section and its end farthest from the second section for supporting the ramp with the first section horizontal at a predetermined height above a supporting surface and the second section extending from the predetermined height to the supporting surface at approximately 45° and curving slightly upward in its area abutting the supporting surface.

1 Claim, 4 Drawing Figures

BOWLING RAMP

BACKGROUND OF THE INVENTION

The present invention relates to a bowling ramp. More particularly, the invention relates to a bowling ramp for the acceleration of a bowling ball by a handicapped, disabled, infirm, and the like, person.

Objects of the invention are to provide a bowling ramp of simple structure, which is inexpensive in manufacture, sturdy, provides long life, without maintenance, light in weight, readily dismantled and assembled, stored and transported with facility and convenience, portable with considerable ease and facility, and functions efficiently, effectively and reliably as a portable ramp for a bowling ball which functions to accelerate a bowling ball placed thereon and thereby permits handicapped, disable, infirm, or the like, persons to bowl and to enjoy bowling.

BRIEF DESCRIPTION OF THE DRAWINGS

In order that the invention may be readily carried into effect, it will now be described with reference to the accompanying drawings, wherein.

DETAILED DESCRIPTION OF THE INVENTION

Figure 1:
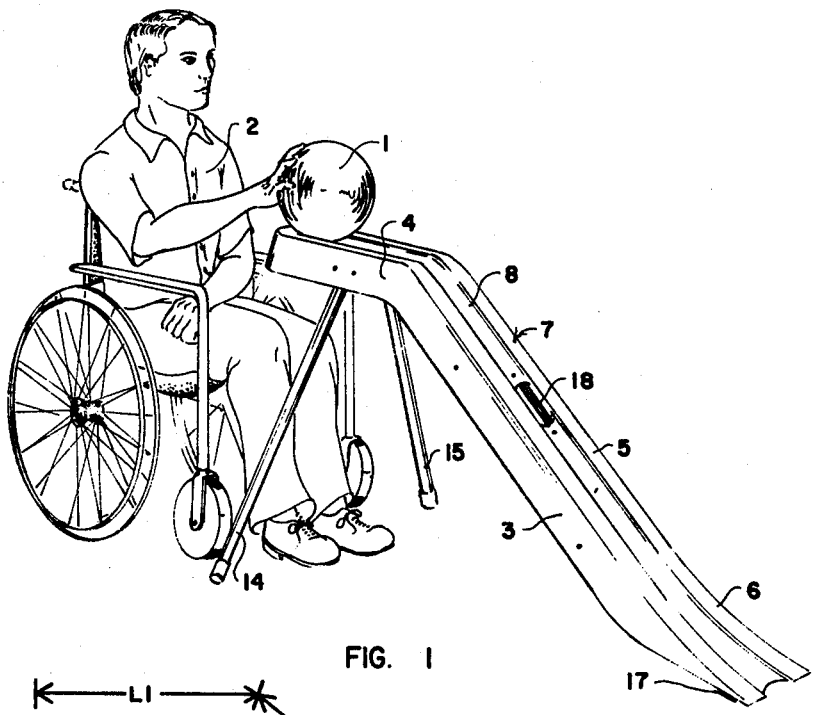
FIG. 1 is a perspective view of an embodiment of the bowling ramp of the invention in use.

The bowling ramp of the invention accelerates a bowling ball 1 and is thus used by a handicapped, disable, infirm, or the like, person 2 to bowl, as shown in FIG. 1.

Figure 2:
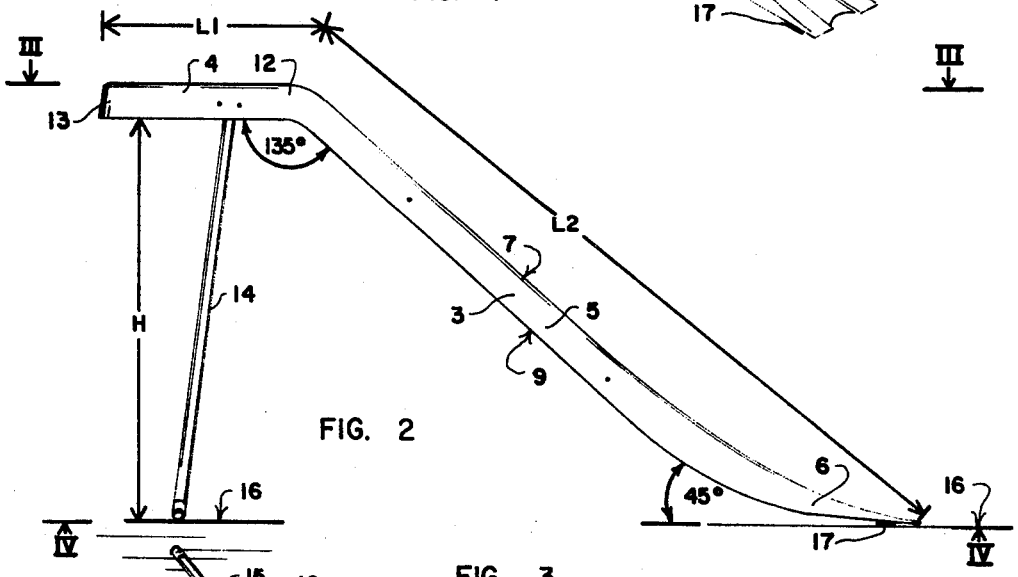
FIG. 2 is a side view, on an enlarged scale, of the embodiment of FIG. 1.
Figure 3:
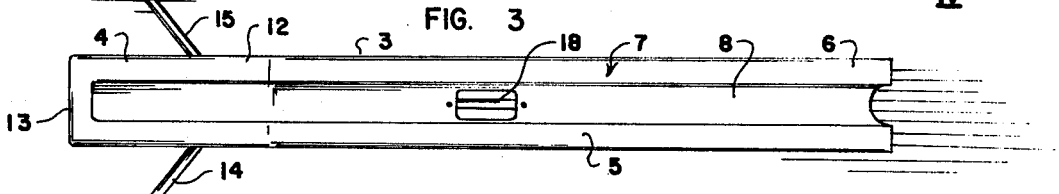
FIG. 3 is a top plan view, taken along the lines III—III, of FIG. 2.

The bowling ramp of the invention comprises a portable ramp 3 for the bowling ball 1. The ramp 3 is bent at approximately 135° to form a first substantially linear section 4 of predetermined length L1 (FIGS. 1 to 3) and a second substantially linear section 5 (FIGS. 1 to 3). The second section 5 has a length L2 (FIG. 2) approximately three times the predetermined length L1.

The second section 5 extends substantially angularly from the first section 4 and curves slightly at its end 6 farthest from said first section (FIGS. 1 to 3). The ramp 3 has a top 7 (FIGS. 1 to 3) with a central channel 8 extending along its length (FIGS. 1 and 3) for directing the bowling ball 1. The ramp 3 also has a bottom 9, as shown in FIGS. 2 and 4.

Figure 4:
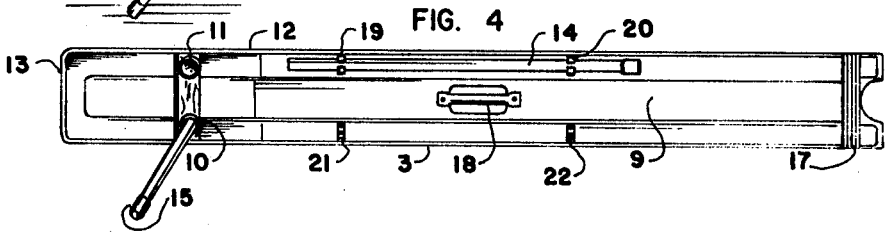
FIG. 4 is a bottom plan view, taken along the lines IV—IV, of FIG. 2, with one leg supported in a socket and the other leg secured for storage or transport of the ramp.

A pair of spaced socket members 10 and 11 are provided at the bottom 9 of the first section 4 intermediate its end 12 joining the second section 5 and its end 13 farthest from said second section (FIGS. 2 to 4).

A pair of legs 14 and 15 are removably accommodated in the socket members 10 and 11 for supporting the ramp 3 with the first section 4 substantially horizontal, at a predetermined height H above a supporting surface 16, as shown in FIGS. 1 and 2. The legs support the ramp 3 with the second section 5 extending from the predetermined height H to the supporting surface 16 at approximately 45°, as shown in FIG. 2. As can be seen in FIGS. 2 and 3, the legs are angularly disposed relative to an imaginary line passing vertically the center of first section 4.

When the legs 14 and 15 support the ramp 3 on the supporting surface 16, the second section 5 curves slightly upward in its area 6 abutting said supporting surface, as shown in FIGS. 1 and 2.

A rubber strip 17 is provided at the bottom of the ramp 3 at the free end of the second section 5 (FIGS. 1, 2 and 4) for abutting the supporting surface 16 and preventing slippage thereof and scuffing thereof.

A handle 18 (FIGS. 1, 3 and 4) is provided in the channel 8 of the second section 5 of the ramp 3 to facilitate carrying of said ramp. The handle 18 is provided in a hole formed through the bottom of the channel 8, so that it does not interfere with the bowling ball 1 as it rolls down the ramp.

Resilient clamps 19, 20, 21 and 22 of any suitable type are provided on the bottom of the second section 5 of the ramp 3, as shown in FIG. 4, for releasably supporting the legs 14 and 15 when the bowling ramp is disassembled for storage and/or transport.

While the invention has been described by means of a specific example and in a specific embodiment, I do not wish to be limited thereto, for obvious modifications will occur to those skilled in the art without departing from the spirit and scope of the invention.

I claim:

1. A bowling ramp for the acceleration of a bowling ball by a handicapped, disabled, infirm, and the like, person, said bowling ramp comprising a portable ramp for a bowling ball, said ramp being bent at approximately 135° to form a first substantially linear section of predetermined length and a second substantially linear section having a length approximately three times the predetermined length, said second section extending substantially angularly from said first section and curving slightly at its end farthest from said first section, said ramp having a top with a central channel extending along its length for directing a bowling ball and a bottom;

a pair of spaced socket members at the bottom of the first section intermediate its end joining the second section and its end farthest from said second section;

a pair of legs removably accommodated in the socket members for supporting the ramp with the first section substantially horizontal at a predetermined height above a supporting surface and the second section extending from said predetermined height to said supporting surface at approximately 45° and curving slightly upward in its area abutting said supporting surface, said legs being symmetrical about a vertical line through the center of the first section and angularly disposed relative to said line since they diverge from said line as their distance from said first section increases;

a rubber strip on the bottom of the ramp at the free end of the second section for abutting the supporting surface and preventing slippage thereon and scuffing thereof;

a handle in the channel of the second section of the ramp for facilitating carrying thereof; and resilient clamps on the bottom of the second section of the ramp for releasably supporting the legs.

* * * * *